United States Patent [19]

Corben

[11] 4,210,450

[45] Jul. 1, 1980

[54] METHOD FOR FORMING PHOTOSENSITIVE SILVER HALIDE EMULSION

[75] Inventor: Leo D. Corben, Swampscott, Mass.

[73] Assignee: Polaroid Corporation, Cambridge, Mass.

[21] Appl. No.: 962,337

[22] Filed: Nov. 20, 1978

[51] Int. Cl.[2] ..... G03C 1/02

[52] U.S. Cl. ..... 430/567; 430/569; 430/202; 430/581

[58] Field of Search ..... 96/94 R, 3

[56] References Cited

U.S. PATENT DOCUMENTS

| | | | |
|---|---|---|---|
| 3,477,852 | 11/1969 | Allentoff et al. | 96/94 R |
| 3,561,971 | 2/1971 | Pestalozzi | 96/94 R |
| 3,597,209 | 8/1971 | Countryman | 96/94 R |
| 3,917,485 | 11/1975 | Morgan | 96/94 R |
| 3,960,557 | 6/1976 | Timson | 96/3 |
| 4,075,020 | 2/1978 | Saleck et al. | 96/94 R |

OTHER PUBLICATIONS

Mees, The Theory of the Photographic Process, p. 316, McMillan Co., 1944.

*Primary Examiner*—J. Travis Brown
*Attorney, Agent, or Firm*—Philip G. Kiely

[57] ABSTRACT

Photosensitive silver halide emulsions are prepared by alternating precipitation of silver halide and the addition of a water-soluble iodide salt which replaces a portion of the less soluble halide.

10 Claims, 1 Drawing Figure

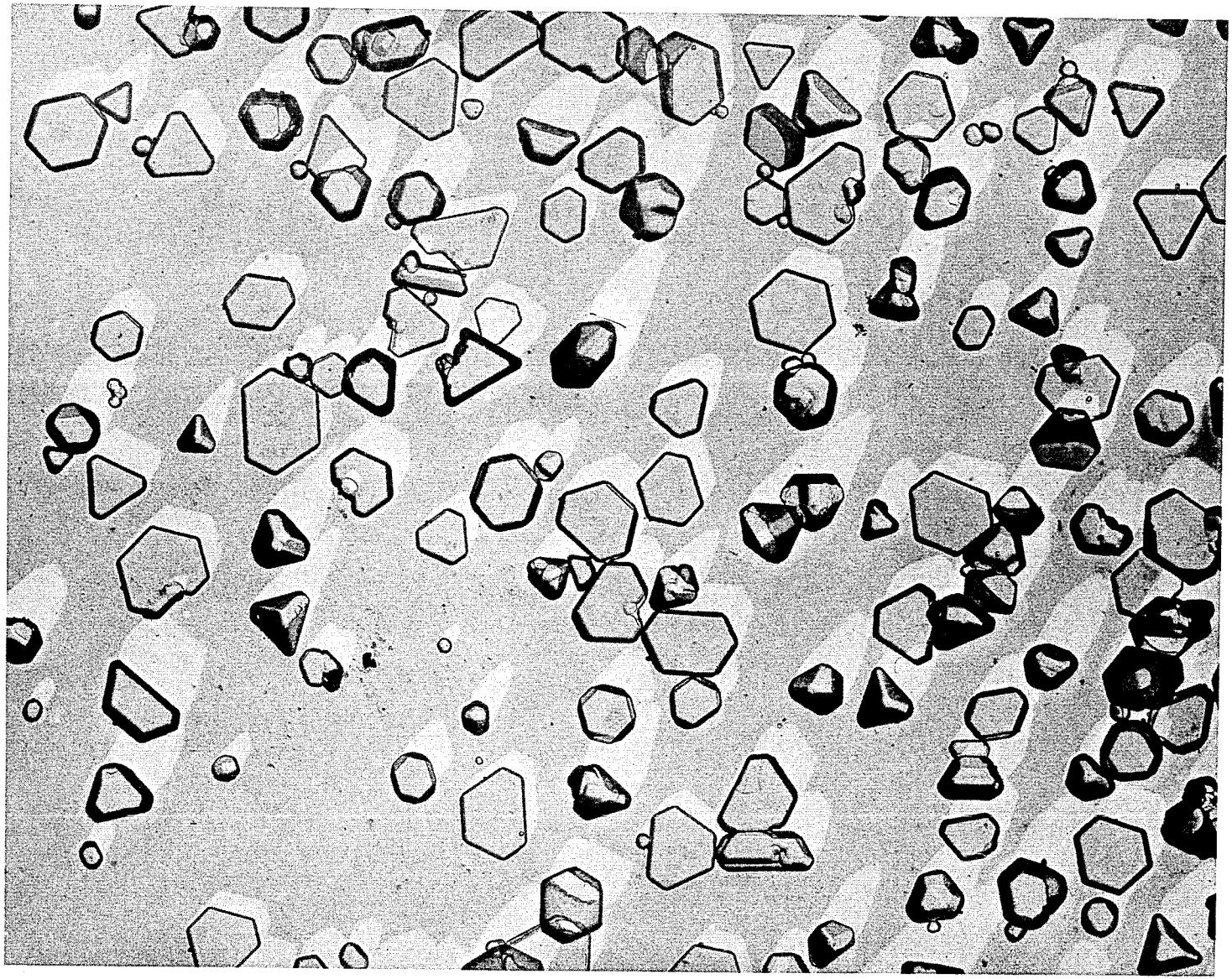

METHOD FOR FORMING PHOTOSENSITIVE SILVER HALIDE EMULSION

BACKGROUND OF THE INVENTION

The effect and value of silver iodide in a silver halide grain is well known to the art. For example, Duffin, "Photographic Emulsion Chemistry," The Focal Press, 1966, page 64, refers to the effect of iodide on the rapidity of grain growth as well as the increased photographic speed and improved spectral sensitization.

Mees, "The Theory of the Photographic Process," McMillan Co., 1946, page 316, reports the treatment of silver bromide grains with potassium iodide to convert the surface of the grain at least partially to silver iodide for the purpose of modulating the rate of reduction of the grain.

Similar disclosures are also found in a number of patents as illustrated by the following:

U.S. Pat. No. 3,561,971 discloses a silver halide emulsion, generally of the print-out type, wherein the grains comprise silver bromide having from 0.2 to 10 mole percent silver iodide on the surface thereof.

Other patents such as U.S. Pat. Nos. 3,477,852 and 3,597,209 disclose "converted" type emulsions where the halide on the surface is replaced by a different halide, such as the "conversion" of chloride to bromide.

SUMMARY OF THE INVENTION

The present invention is directed to a photo-sensitive silver halide emulsion comprising silver halide grains wherein the silver halide grains are formed by reacting, in a conventional manner, a water-soluble silver salt and a water-soluble halide salt. A solution of a water-soluble iodide is then added which replaces some of the more soluble halide. Additional silver salt and halide salt are reacted and then a second addition of the iodide is carried out in the manner described above. The alternate formation of silver halide iodide additive may be continued for any desired number of steps. Preferably, the surface of the grain comprises an iodide-rich layer.

Ripening and sensitization may be carried out in the conventional manner.

BRIEF DESCRIPTION OF THE FIGURE

The photomicrograph shows silver halide grains prepared according to the procedure of the present invention.

DETAILED DESCRIPTION OF THE INVENTION

The present invention is concerned with silver halide grains prepared by the sequential formation of silver halide, i.e., silver chloride or silver bromide and silver iodide. In the process of the present invention, silver halide is precipitated and then a water-soluble iodide salt is added to the silver halide; silver halide is again precipitated and then a water-soluble iodide salt is again added. This sequence of steps may be repeated as often as desired, but at least twice, and preferably three times. The last step in the process is preferably the iodide addition step to provide an iodide-rich surface on the grains.

The halide composition of the grains of the present invention may vary as to type and quantity. Thus, the grain may comprise chloroiodobromide, iodobromide or chloroiodide. It shoulde also be noted that the initial halide composition of the grain may differ from the final halide composition. Thus, an initial chlorobromide grain, that is, before the iodide salt addition, may result in an iodobromide grain by the iodide anion.

In a preferred embodiment, the grains of the present invention may comprise about 0.2 to 10 mole percent iodide, 0–5 mole percent chloride and the remainder bromide. In a particularly preferred embodiment, the grains comprise about 1 mole percent chloride and the remainder bromide.

The grain size may range from about 0.1 to 4$\mu$ in diameter depending upon the particular product and process the emulsion is to be employed in.

As stated above, any conventional silver halide precipitation technique may be employed, such as single jet, double jet and "dump" techniques. The conditions may be neutral, ammoniacal or partially ammoniacal. In brief, the method of formation of the silver halide (as opposed to the iodide addition) may comprise any of the techniques and materials known to the art for the formation of silver halide.

Although three iodide addition steps are preferred, it should be understood that any number of steps may be employed at the option of the operator.

The following non-limiting example illustrates the preparation of silver halide emulsions within the scope of the present invention.

EXAMPLE

The following solutions were prepared:

| | | |
|---|---|---|
| I | Distilled water | 7400.0 g. |
| | Inert Gelatin | 132.0 g. |
| | Ammonium bromide | 476.0 g. |
| II | Potassium Chloride | 73.16 g. |
| | Ammonium bromide | 722.8 g. |
| | Ammonium iodide | 53.2 g. |
| | Ammonium hydroxide (30%) | 766.0 g. |
| | Distilled water to make a total of | 5116.0 g. |
| III | Silver nitrate | 1593.0 g. |
| | Ammonium iodide | 4.23 g. |
| | Distilled water to make a total of | 6224.0 g. |
| IV | 2.0% solution of ammonium iodide in distilled water | 400.0 g |

Solutions I, II and III were brought to 50° C. One-third of Solutions II and III were pumped into Solution I over a 1-minute time period at 50° C. One-third of Solution IV was then added to the reaction mixture. After 30 seconds, the second-third of Solutions II and III were added to the reaction mixture over a 1-minute time period. The second-third of Solution IV was then added to the reaction mixture. After 30 seconds, the remaining third of Solutions II and III were pumped into the reaction mixture over a 1-minute time period. The remaining third of Solution IV was added and the mixture was kept at 50° C. for 4 minutes.

The temperature was reduced to 15° C. and the pH adjusted to 2.70 with sulfuric acid. The thus-formed gelatin flocculate containing the occluded silver halide was washed using successive changes of distilled water to a conductivity of the supernatant fluid of 80 $\mu$mhos. As much supernatant fluid as possible was then discarded and 624.0 g. of bulking gelatin was added plus distilled water to make a total weight of 5910 g. After a soak of one hour at room temperature, the emulsion was reconstituted at 48° C. by adding 40.0 g. of 10% sodium hydroxide.

Chemical ripening was carried out at 53° C. by adding the following, at 30-second intervals, per 100 g. of reconstituted emulsion:

Ammonium gold thiocyanate complex (0.107% as gold chloride in water): 0.90 ml.

Sodium Thiosulfate (0.02% in water): 1.20 ml.

N,N-dimethyl selenourea (0.001% in methanol): 0.90 ml.

After 270 minutes photographic stabilizers were added.

The emulsion was then brought to 40° C. and panchromatic sensitizing dyes were added.

The average grain size, as determined by Coulter Counter, was 0.88μ mean volume diameter.

The photomicrograph shows grains prepared according to the method of the present invention wherein the average grain size, as determined by Coulter Counter is 0.80μ mean volume diameter and, as determined by Zeiss Counter, 0.78μ mean volume diameter.

It is believed that the silver halide grains prepared by the novel method of the present invention comprise a plurality of iodide-rich layers. Thus, the grains of the present invention may comprise alternating layers of silver chloroiodobromide and silver iodide as a result of the replacement by iodide of the more soluble halide.

With regard to the use of chemical sensitizing agents suitable for employment in the present invention, mention may be made of U.S. Pat. Nos. 1,574,944; 1,623,499; 2,410,689; 2,597,856; 2,597,915; 2,487,850; 2,518,689; 2,521,926; and the like, as well as Neblette, C. B., *Photography, Its Materials and Processes,* 6th Ed., 1962.

Spectral sensitization of the silver halide grains may be accomplished by contact of the grain composition with an effective concentration of the selected spectral sensitizing dyes dissolved in an appropriate dispersing solvent such as methanol, ethanol, acetone, water and the like; all according to the traditional procedures of the art, as described in Hamer, F. M., *The Cyanine Dyes and Related Compounds,* as well as the above-mentioned disposition of the sensitizers in the electrolyte solution prior to or during grain formation.

Reduction sensitization of the grains prior to or subsequent to the addition of the binder may also be accomplished employing conventional materials known to the art, such as stannous chloride.

Sensitizers of the solid semiconductor type, such as lead oxide, may also be employed.

Additional optional additives, such as coating aids, hardeners, viscosity-increasing agents, stabilizers, preservatives, and the like, also may be incorporated in the emulsion formulation, according the the conventional procedures known in the photographic emulsion manufacturing art.

The novel silver halide emulsions within the scope of the present invention are particularly useful in silver diffusion transfer processes, such as those disclosed in U.S. Pat. Nos. 2,861,885; 2,726,154; 2,944,894; 3,536,488; 3,615,426; 3,615,427; 3,615,428; 3,615,429 and 3,894,871 and the color diffusion transfer processes such as those disclosed in U.S. Pat. Nos. 2,983,606; 3,443,939; 3,443,940; 3,227,550; 3,227,551; 3,227,552; 3,227,554; 3,243,294; 3,445,228; 3,415,644; 3,415,645; 3,415,646; 3,473,925; 3,573,043; 3,576,625; 3,573,042; 3,594,164 and 3,594,165.

What is claimed is:

1. The method for forming photosensitive silver halide grains which comprises the following steps, in sequence:

(a) precipitating silver chloroiodobromide grains;

(b) adding a water-soluble iodide salt to said chloroiodobromide grains;

(c) precipitating additional silver chloroiodobromide;

(d) adding a water-soluble iodide salt to said chloroiodobromide grains;

(e) precipitating additional silver chloroiodobromide;

(f) adding a water-soluble iodide salt to said chloroiodobromide grains.

2. The method as defined in claim 1 wherein said precipitation is carried out in an aqeous gelatin solution.

3. The method as defined in claim 1 wherein said silver halide grains are precipitated by the reaction of silver nitrate and water-soluble salts of chlorine, bromine and iodine.

4. The method as defined in claim 3 wherein said salts of chlorine, bromine and iodine comprise ammonium salts.

5. The method as defined in claim 1 wherein said water-soluble iodide salt is ammonium iodide.

6. The method as defined in claim 3 wherein said grains comprise about 0.3 to 10 mole percent iodide, 1 to 5 percent chloride and the remainder bromide.

7. The method as defined in claim 6 wherein said grains comprise about 7 mole percent iodide, about 1 mole percent chloride and the remainder bromide.

8. The method as defined in claim 1 wherein the grain size ranges from about 0.1 to 4 microns average diameter.

9. The method as defined in claim 8 wherein said grain size is 0.9 microns average diameter.

10. The method as defined in claim 1 wherein said silver halide grains are formed in the presence of ammonia.

* * * * *